US007384171B2

(12) United States Patent
Schöning

(10) Patent No.: US 7,384,171 B2
(45) Date of Patent: Jun. 10, 2008

(54) LCD BILLBOARD

(75) Inventor: Michael Schöning, Waldfeucht (DE)

(73) Assignee: Distec GmbH, Heinsberg (DE)

( * ) Notice: Subject to any disclaimer, the term of this patent is extended or adjusted under 35 U.S.C. 154(b) by 0 days.

(21) Appl. No.: 10/587,687

(22) PCT Filed: Feb. 2, 2005

(86) PCT No.: PCT/DE2005/000165

§ 371 (c)(1),
(2), (4) Date: Jul. 27, 2006

(87) PCT Pub. No.: WO2005/076245

PCT Pub. Date: Aug. 18, 2005

(65) Prior Publication Data

US 2007/0165407 A1 Jul. 19, 2007

(30) Foreign Application Priority Data

Feb. 5, 2004 (DE) ..... 10 2004 005 876

(51) Int. Cl.
*F21V 23/04* (2006.01)

(52) U.S. Cl. ..... 362/276; 362/812

(58) Field of Classification Search ..... 362/276, 362/812; 40/541
See application file for complete search history.

(56) References Cited

U.S. PATENT DOCUMENTS

| | | | | |
|---|---|---|---|---|
| 4,791,417 | A | 12/1988 | Bobak et al. | |
| 5,016,143 | A * | 5/1991 | Aikens | 362/560 |
| 5,517,393 | A * | 5/1996 | Townsend et al. | 362/233 |
| 6,705,750 | B1 * | 3/2004 | Won | 362/419 |
| 2002/0163880 | A1 | 11/2002 | Matsumoto | |
| 2003/0146891 | A1 | 8/2003 | Poliakine | |

FOREIGN PATENT DOCUMENTS

| | | |
|---|---|---|
| EP | 0 829 844 A | 3/1998 |
| JP | 59 219078 A | 12/1984 |
| JP | 02 100088 A | 4/1990 |
| WO | WO 01/88 688 A1 | 11/2001 |
| WO | WO 02/073 57 A2 | 1/2002 |

* cited by examiner

*Primary Examiner*—Jong-Suk (James) Lee
*Assistant Examiner*—Robert May
(74) *Attorney, Agent, or Firm*—Collard & Roe, P.C.

(57) ABSTRACT

The invention relates to a large-surface billboard for outdoors advertising. In order to generate a luminosity of the LCD elements of the billboard, extraneous light is required. In times of insufficient sun light, an artificial lighting device activates the luminosity. The aim of the invention is to prevent the lighting device from casting a shadow onto the billboard during daylight. For this purpose, the lighting device is moved out from its beam path incident on the billboard when there is sufficient solar radiation.

3 Claims, 2 Drawing Sheets

LCD BILLBOARD

CROSS REFERENCE TO RELATED APPLICATIONS

Applicant claims priority under 35 U.S.C. §119 of German Application No. 10 2004 005 876.8 filed Feb. 5, 2004. Applicant also claims priority under 35 U.S.C. §365 of PCT/DE2005/000165 filed Feb. 2, 2005. The international application under PCT article 21(2) was not published in English.

BACKGROUND OF THE INVENTION

1. Field of the Invention

The invention relates to a large-area LCD billboard for outdoor advertising, whereby the luminosity of the reflective LCD elements of the board depends on the intensity and direction of the lighting, and an artificial lighting device with lamps is assigned to the board for this purpose, for times when the sunlight is insufficient, which lamps illuminate the board from the viewer side, if necessary. The abbreviation LCD stands for "liquid crystal display." The artificial light is supposed to have essentially the same effect as sunlight on the LCD elements, in the end result.

2. Descrtion of Related Art

In WO 02/073 57/A2, lamps for lighting an advertising image produced in conventional manner are indicated. The lamps light the advertising image either from the viewer side, or the advertising image is lighted from the rear, if the advertising poster, in each instance, is at least translucent.

In the reference WO 01/88 688 A1, an LCD board is described, to which lighting elements are assigned, which are regulated in accordance with the incident sunlight, using a control unit.

However, when the sun shines, shadows of the lighting elements can show on the LCD board.

On LCD boards that are set up on roadways or on building walls, and the surface of which can have a width and length of several meters ("large-area"), it is possible to display advertising motifs in any desired sequence, for example from the central office of an advertising company, and to delete them again. The individual LCD elements together produce a large-area image, the luminosity of which, in other words its brightness and colors, is produced or reinforced for the intended purpose, namely advertising that is visible over a great distance, only by means of incident outside light.

The effect of the outside light seems to consist in the fact that the light is reflected at the LCD elements, which are often protected behind a glass pane. During the day, sunlight is completely sufficient as the outside light. However, the luminosity of the billboard decreases to the point of becoming pale if the daylight is relatively slight, for example due to dark clouds or during dusk, or when it is entirely absent at night. For these times of insufficient daylight, it has been the practice until now to provide artificial lighting devices with lamps on the LCD billboards, which lamps illuminate the board on the viewer side, for example at a slant from above, like the sun, and cause the LCD elements to luminesce in their color, in each instance.

The lighting devices, i.e. their lamps are installed in such a manner that they do not impair the image effect of the advertising motif, in each instance. The lamps are therefore affixed outside the edge of the billboard, in such a manner that they do not stand between the viewer and the advertising motif—within a predetermined angle range in front of the billboard—in other words do not cover it. On the other hand, however, the lighting devices are supposed to be positioned in such a manner that they can illuminate the board from the viewer side, like the sun. As stated, this can have the result that the lighting devices show as shadows on the billboard in daylight.

SUMMARY OF THE INVENTION

The invention is based on the task, on the one hand, of affixing the lighting device on the billboard in such a manner that it reinforces or produces the desired luminosity (brightness and colors) of the LCD elements even in the case of weak or absent sunlight, as if the sun were shining on the board and, on the other hand, of taking measures to prevent the lighting device from appearing as a shadow on the billboard when sunlight is sufficient.

The solution according to the invention is indicated, for the LCD billboard defined initially, in the characterizing part of claim 1. Some improvements and further embodiments of the invention are described in the dependent claims.

According to the invention, activation means for physically moving the lighting device out of the beam path of the sunlight that falls on the billboard are provided. In other words, the lighting device is moved away from the beam path of the sunlight falling onto the billboard for times of sufficient sunlight. In this way, the result is achieved that on the one hand, the lighting device can optimally fulfill its task of reinforcing brightness and colors of the LCD elements in such a manner that the advertising motif, in each instance, is visible at a distance when the daylight is insufficient and, on the other hand, cannot cast a shadow onto the billboard when the sunlight is sufficient, because it is not situated in the beam path between sun and billboard.

Preferably, the lighting device is supposed to possess at least one active lighting position with illumination of the LCD elements for times of insufficient sunlight, and at least one inactive reserve position for times of sufficient sunlight. In the reserve position, the lamps (individual lamps or light strips) of the lighting device are generally supposed to be shut off. To generate optimal brightness (with reference to the viewer), preferably a single active lighting position is determined, for example by means of experiments. For reasons of effort and expense, among other things, it has proven to be practical to also install only a single reserve position, in which the lighting device cannot cast a shadow onto the billboard no matter what position the sun is in.

Positioning of the lighting device, in other words its movement between the active lighting position and the inactive reserve position, is preferably supposed to be regulated by means of a sensor, within the scope of the invention, which sensor records whether or not the sunlight falling onto the billboard is sufficient to generate the desired luminosity. Preferably, such a sensor is affixed to the lighting device in such a manner that it can detect and evaluate the incident sunlight both in the active lighting position and in the inactive reserve position. Sensor controls of this type are known, for example in connection with sun protection devices. Fundamentally, however, switching from the active to the inactive position of the lighting device can also take place manually.

Within the scope of the invention, various activation means for physically moving the lighting device out of the beam path of the sunlight falling on the billboard can be provided. Motorized activation means for tilting, flipping or pulling the lighting device, i.e. its lamps, away out of the aforementioned beam path of the sunlight falling on the billboard are advantageous in this sense. The lighting device, i.e. its lamps, can also be moved using telescope, cable, or spring systems. An effect that is particularly pleasing esthetically can be achieved if the lighting device is completely moved out of the viewing field of the viewer during the time of sufficient sunlight, in other words by means of counter-sinking it in the frame of the board or behind the board, so that the viewer cannot see it at all.

BRIEF DESCRIPTION OF THE DRAWINGS

Some details of the invention will be described using a schematic representation of an exemplary embodiment. The drawing shows.

DETAILED DESCRIPTION OF PREFERRED EMBODIMENTS

Figure 1:
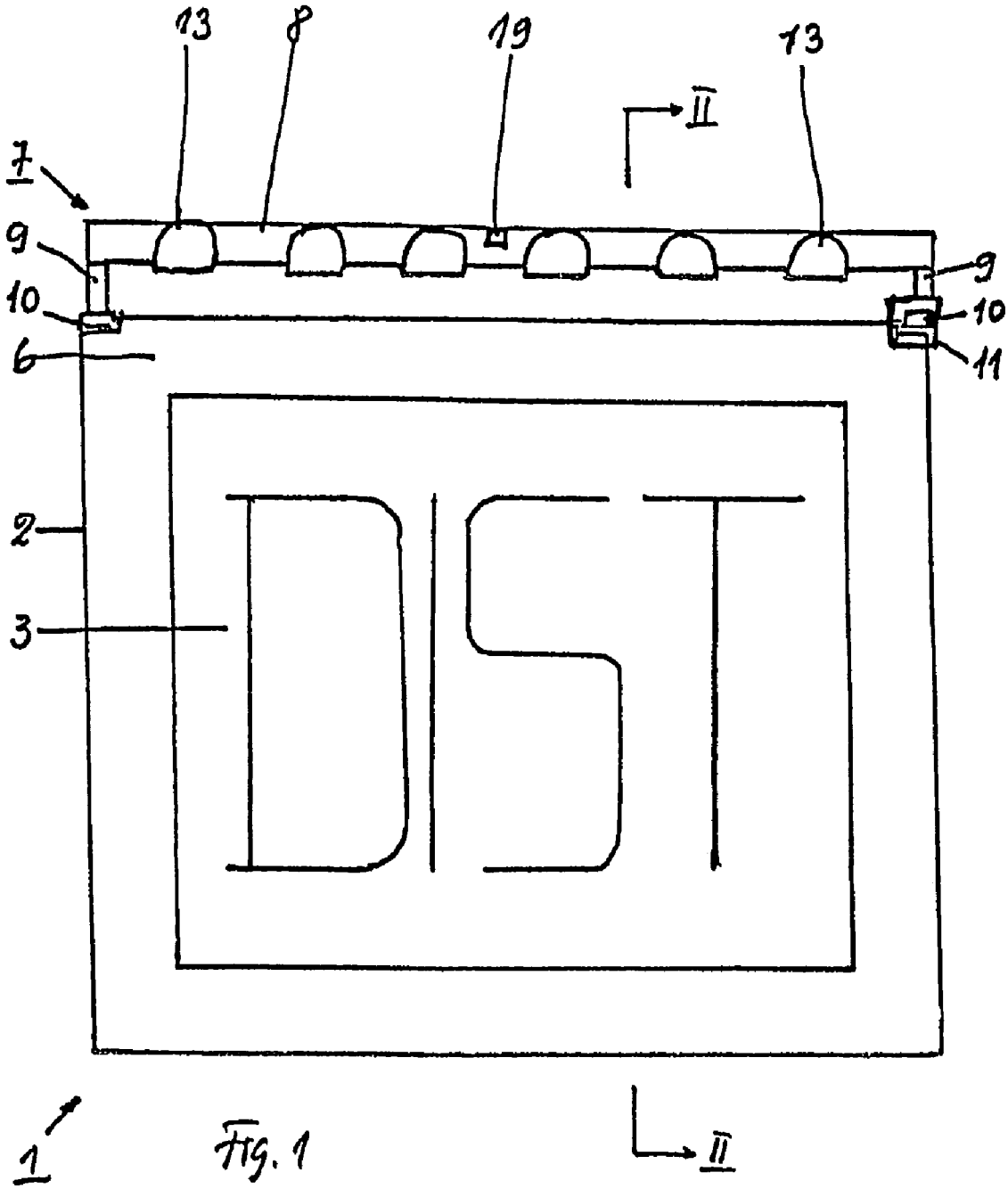
FIG. 1 a view of an LCD billboard from the viewing angle of a viewer.
Figure 2:
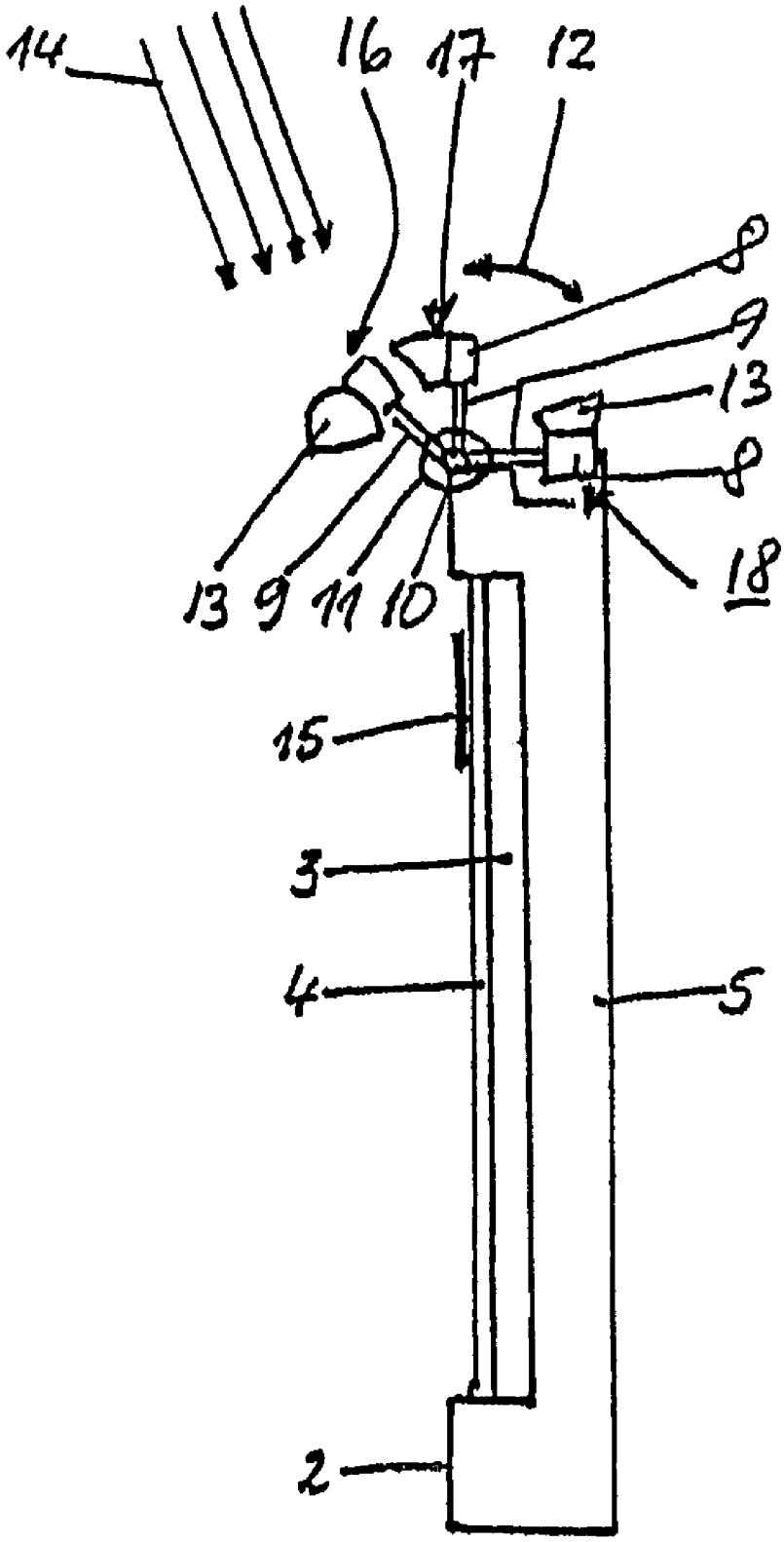
FIG. 2 a section along the line II-II of FIG. 1.

The billboard, designated as a whole as 1, of FIGS. 1 and 2 consists essentially of a frame 2 and an advertisement surface, i.e. LCD surface 3, which is composed of a plurality of LCD elements (not shown in detail). The LCD surface 3 as shown is protected towards the front (weather and viewer side) by means of a glass pane 4. On the back of the LCD surface 3, there can be housing parts 5, for example with the required electrical equipment.

In the exemplary embodiment shown in the drawing, a lighting device indicated as a whole as 7 is shown on the upper crosspiece 6 of the frame 2. Said device comprises a rail 8 that runs parallel to the upper crosspiece 6 and is installed on the upper crosspiece 6 so that it can pivot in hinges having a pivot axis 10, using shanks 9 (that stand perpendicular to the crosspiece 6). At least one of the shanks 9 can have a motor 11 assigned to it, which can be used to move the shank 9 and therefore the rail 8 in the pivoting direction 12. Individual lamps 13, light strips, or similar lighting means can be installed on the rail 8.

During the day, when the sun is shining, the sunbeams 14 can fall onto the LCD surface 3, i.e. the glass pane 4, in the direction of the arrow as shown. The light from the lamps 13 is supposed to light the LCD surface 3 from approximately the same direction. If the rail 8 with the lamps 13 is pivoted into the corresponding position and the sun is shining, a shadow 15 is therefore cast onto the image of the advertising surface. To avoid such a shadow, it is therefore provided to take the lighting device 7 out of the beam path of the sunlight to the billboard, i.e. LCD surface 3 during the time of sufficient sunlight, in other words during the time when the shadow 15 can show at all. For this purpose, it is provided in the exemplary embodiment to move the rail 8 with the lamps 13 out of the active position 16 according to FIG. 2 into the inactive pivoted position 17 (FIG. 2), in the pivoting direction 12. In the inactive pivoted position 17 shown, however, the rail 8 with its lamps 13 can still be seen by the viewer. For esthetic reasons, it is therefore considered to be advantageous to move the rail 8 with the lamps 13 farther back (in the direction of the top or rear, respectively, of the frame 2), for example to pivot it, so that the rail 8 and its lamps 13 can no longer be seen by the viewer in the counter-sunk position 18 shown.

In the exemplary embodiment, it is provided to attach the lamps 13 to a common rail 8 (lamp carrier). Alternatively, the lamps can also be configured so that they can be moved individually. For back and forth movement, the lamps, i.e. their carrier can also be attached to telescopes. Motors with remote control are preferably preferred for adjusting or pivoting the attachment means of the lamps. The motors can be supported with spring force, for example can act counter to an elastic return force. The transfer of the force between motor and the part of the lighting device in question can take place directly on the pivoting axis 10 (as shown in FIG. 2), but also by way of gear mechanisms of any kind (with gear wheels and/or cable controls).

To control the lighting device 7 as a function of the position of the sun, a light sensor 19 that detects the lighting of the LCD surface 3 can be provided, for example on the rail 8 but also on the board (1), particularly in the LCD surface, and coupled with the motor 11.

REFERENCE SYMBOL LIST

1=billboard
2=frame
3=LCD surface
4=glass pane
5=housing part
6=upper crossbar (2)
7=lighting device
8=rail
9=shank
10=pivot axis
11=motor
12=pivoting direction
13=lamp
14=sunbeam
15=shadow
16=active pivoted position
17=inactive pivoted position
18=countersunk position
19=light sensor

The invention claimed is:

1. A large-area LCD billboard for outdoor advertising comprising:

(a) a board having a viewer side comprising reflective LCD elements having a luminosity dependent on intensity and direction of lighting, said board comprising a frame having a pivotally-mounted rail and a recess in a rear portion of the frame away from the viewer side;

(b) an artificial lighting device provided on said board comprising a plurality of lamps mounted on said rail for illuminating the board from the viewer side for periods when sunlight falling on the board is insufficient;

(c) motorized activation means connected to said lighting device for physically moving the rail with the lighting device into a recessed position toward the rear portion of the frame and the lamps into the recess and out of a beam path of the sunlight falling on the board so that the rail and the lamps can no longer be seen by a viewer in the recessed position; and (d) a control system with a light sensor for activating the activation means.

2. A method of illuminating a large-area LCD billboard for outdoor advertising comprising the steps of:

(a) providing an LCD billboard having a viewer side comprising LCD reflective elements having a luminosity dependent on intensity and direction of lighting and a frame having a pivotally-mounted rail and a recess in a rear portion of the frame away from the viewer side, an artificial lighting device comprising a plurality of lamps mounted on the rail for illuminating the board from the viewer side for periods when sunlight falling on the board is insufficient, motorized activation means connected to the lighting device for physically moving the rail with the lighting device into a recessed position toward the rear portion of the frame and the lamps into the recess and out of a beam path of the sunlight, and a control system with a light sensor for activating the activation means;

(b) moving the rail with the lighting device into the recessed position toward the rear portion of the frame and the lamps into the recess and away from the beam path via the motorized activation means so that the rail and the lamps can no longer be seen by a viewer in the recessed position.

3. The method according to claim 2 wherein the lighting device possesses only a single active lighting position and a single inactive position comprising a reserve position or a recessed position with reference to the board.

* * * * *